US006616368B2

(12) United States Patent
Birchler et al.

(10) Patent No.: US 6,616,368 B2
(45) Date of Patent: Sep. 9, 2003

(54) TRAFFIC BARRICADE

(75) Inventors: Terry M. Birchler, Bexley, OH (US); Kia-Sheng Cheng, Hilliard, OH (US)

(73) Assignee: Custom Plastech, Ltd., Chagrin Falls, OH (US)

( * ) Notice: Subject to any disclaimer, the term of this patent is extended or adjusted under 35 U.S.C. 154(b) by 0 days.

(21) Appl. No.: 10/077,410

(22) Filed: Feb. 15, 2002

(65) Prior Publication Data

US 2002/0136603 A1 Sep. 26, 2002

Related U.S. Application Data

(60) Provisional application No. 60/269,465, filed on Feb. 16, 2001.

(51) Int. Cl.[7] ..... E01F 9/017

(52) U.S. Cl. ..... 404/10; 404/6; 404/9; 256/13.1

(58) Field of Search ..... 404/6, 9, 10; 256/1, 256/13.1

(56) References Cited

U.S. PATENT DOCUMENTS

| | | | | | |
|---|---|---|---|---|---|
| 2,515,313 | A | * | 7/1950 | Pember | 40/606 |
| 2,863,238 | A | * | 12/1958 | Keech | 40/606 |
| 3,662,482 | A | * | 5/1972 | Sarkisian | 40/602 |
| 4,183,695 | A | * | 1/1980 | Wilcox | 404/6 |
| 4,373,464 | A | * | 2/1983 | Blau | 116/63 R |
| D278,416 | S | * | 4/1985 | Moran | D10/109 |
| 4,588,324 | A | * | 5/1986 | Goellner | 404/10 |
| 4,792,258 | A | * | 12/1988 | Goff | 404/6 |
| 4,875,797 | A | * | 10/1989 | Hartwig | 404/9 |
| 4,880,332 | A | * | 11/1989 | Batchelor | 404/6 |
| 4,991,994 | A | * | 2/1991 | Edouart | 404/10 |
| 5,238,322 | A | * | 8/1993 | Stirtz | 404/10 |
| 5,261,647 | A | * | 11/1993 | Venegas et al. | 256/13.1 |
| 5,273,371 | A | * | 12/1993 | Hugron | 404/10 |
| 5,309,674 | A | * | 5/1994 | Weibel | 49/49 |
| 5,442,871 | A | * | 8/1995 | Sarkisian et al. | 40/606 |
| 5,500,642 | A | * | 3/1996 | Battle | 340/932.2 |
| 6,131,886 | A | * | 10/2000 | Venegas, Jr. | 256/59 |

* cited by examiner

*Primary Examiner*—Thomas B. Will
*Assistant Examiner*—Alexandra K. Pechhold
(74) *Attorney, Agent, or Firm*—Fay, Sharpe, Fagan, Minnich & McKee, LLP

(57) ABSTRACT

A traffic barricade includes a base which supports an upright member. The base includes two removably interlocking sections, each having an enlarged portion. The enlarged portions defines a socket for closely receiving a tab extending from the upright member. A deformably resilient material surrounds the socket, permitting the upright member to deflect slightly and return to a substantially perpendicular orientation relative to the base. The upright member incorporates integral structural supports which permit the barricade upright member to maintain an upright member orientation without additional external support mechanisms.

20 Claims, 6 Drawing Sheets

TRAFFIC BARRICADE

This application claims the priority of U.S. Provisional Application Serial No. 60/269,465, filed Feb. 16, 2001.

BACKGROUND OF THE INVENTION

The present invention relates to traffic barricades generally. It finds particular application in conjunction with molded plastic barricades and will be described with particular reference thereto.

A traffic barricade is typically a portable or fixed device having from one to three rails with appropriate markings. It is used to control traffic by closing, restricting, or delineating all or a portion of the right-of-way.

The Manual on Uniform Traffic Control Devices (MUTCD) classifies barricades as belonging to one of three types: Type I, Type II, or Type III.

Type I or Type II barricades are intended for use in situations where traffic is maintained through the temporary traffic control zone. They may be used singly or in groups to mark a specific condition, or they may be used in a series for channelizing traffic. Type I barricades normally would be used on conventional roads or urban streets and arterials. Type II barricades have more retroreflective area and are intended for use on expressways and freeways or other high-speed roadways.

Type III barricades are used at a road closure. They may extend completely across a roadway or from curb to curb. Where provision is made for access of authorized equipment, vehicles, and/or local traffic, it is often necessary to move the barricade between a position blocking traffic and a position permitting traffic.

Barricades are often heavy and cumbersome to erect and move. Moreover, once erected, barricades manufactured from wood and metal are often completely destroyed when impacted by a vehicle. They can also heavily damage the vehicle striking them. More importantly, they can injure the vehicle's occupants or a road worker in the vicinity. On the other hand, the known lightweight plastic barricades, which would cause less damage to a vehicle or passengers, are disadvantageous because they are destroyed by impact of a vehicle.

The present invention contemplates a new, improved barricade which overcomes the above mentioned difficulties and others while providing better and more advantageous results.

BRIEF SUMMARY OF THE INVENTION

In accordance with one embodiment of the present invention, a barricade is provided. The barricade includes a base including first and second elongate support members which define sockets and a ridge adjacent the first socket. An upright member is supported in a substantially upright position by the base, the upright member including a first leg member which is supported adjacent a first end by the first socket, and a second leg member which is supported adjacent a first end by the second socket. The ridge allows the upright member to deflect upon impact by a vehicle. Signaling means are attached to the barricade member for providing an instruction or warning to vehicular traffic.

In accordance with another embodiment of the present invention, a barricade is provided. The barricade includes a base which supports an upright member in a generally vertical orientation. The base includes two removably interlocking sections. Each interlocking section includes a socket for closely receiving a distal end of the upright member and a resilient, deformable area adjacent the socket, the deformable area deforming when the barricade is subjected to an impact, permitting the upright member to deflect somewhat and then return to a generally vertical orientation when the impact is removed.

One aspect of the present invention resides in an easily erected, portable barricade which resists damage upon impact with a vehicle.

Another aspect of the present invention is the provision of a traffic barricade which reduces the hazard posed to vehicle occupants or road workers if the barricade is hit by a vehicle.

Still another aspect of the present invention resides in a lightweight barricade upright which does not require external bracing and resists toppling.

Other aspects of the present invention will become apparent to those skilled in the art upon reading and understanding of the following detailed description of the preferred embodiment.

BRIEF DESCRIPTION OF THE DRAWINGS

The invention may take physical form in certain parts and arrangements of parts, and in various steps and arrangements of steps. The drawings are only for purposes of illustrating the preferred embodiments and are not to be construed as limiting the invention.

DETAILED DESCRIPTION OF THE PREFERRED EMBODIMENTS

Figure 1:
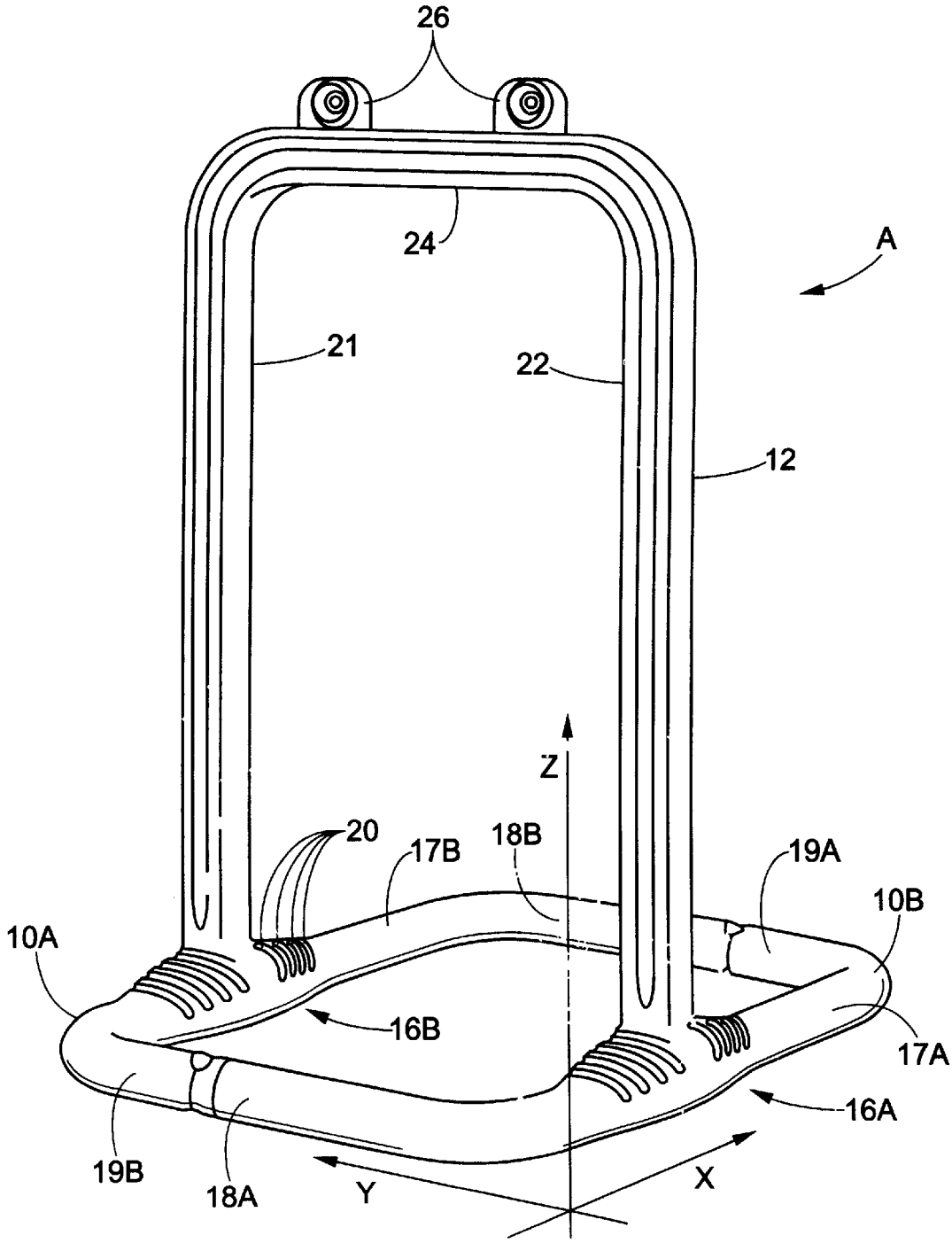
FIG. 1 is a perspective view of a molded traffic barricade according to the present invention.

With reference to FIG. 1, a traffic barricade A includes a base 10 and an upright member 12 supportively engaged with the base 10, which extends generally perpendicular from the base. The base 10 in the illustrated embodiment includes two interlocking sections 10A, 10B, allowing the barricade A to be assembled and disassembled quickly. The base is placed on the ground or other generally horizontal surface on which the barricade is to be positioned. The sections 10A and 10B together form a generally rectangular-shaped member having four interconnected sides, which each contact the ground and support the upright member from tipping forwardly, rearwardly or to the sides. It is to be appreciated that the interlocking sections may be replaced by a single section which defines a rectangle, or by 3, 4, or more sections which interlock together. Additionally, the base may be circular, oval, or square-shaped, or the like.

As will become apparent in the discussion below, base 10 also includes a pair of opposed enlarged areas 16A, 16B.

Preferably, as shown in Figure 1, the generally U-shaped section 10A includes a central portion or elongate support member 17A and two legs 18A, 19A, attached one at either end of the central portion, leg 18A being slightly longer than leg 19A. Correspondingly, the generally U-shaped section 10B includes a central portion or elongate support member 17B and two legs 18B, 19B, attached one at either end of the central portion, leg 18B being slightly longer than leg 19B. The central portion 17A, 17B and optionally the legs 18A, 18B are hollow tubes.

The enlarged areas 16 are formed in each of central portions 17, 17' of interlocking sections 10A and 10B, respectively, on opposite sides of the base. The enlarged areas are thus of increased cross sectional area relative to the adjoining portions of the central portion 17A, 17B. The enlarged areas preferably each define a socket (discussed below) for receiving a respective distal end of the upright member 12. Additionally, enlarged areas 16 further include integral surface undulations or ridges 20 which permit upright member 12 to deflect slightly in the x direction. The sections 10A and 10B of the base are hollow tubular members, made of a suitable conventional thermoplastic material, such as by blow molding. However, the thickness of the tubular wall remains the same in the undulating regions. Those skilled in the art will appreciate that enlarged areas 16 may alternately be comprised of other materials permitting the upright member 12 to deflect, such as rubber, resilient plastics, and the like.

Figure 2:
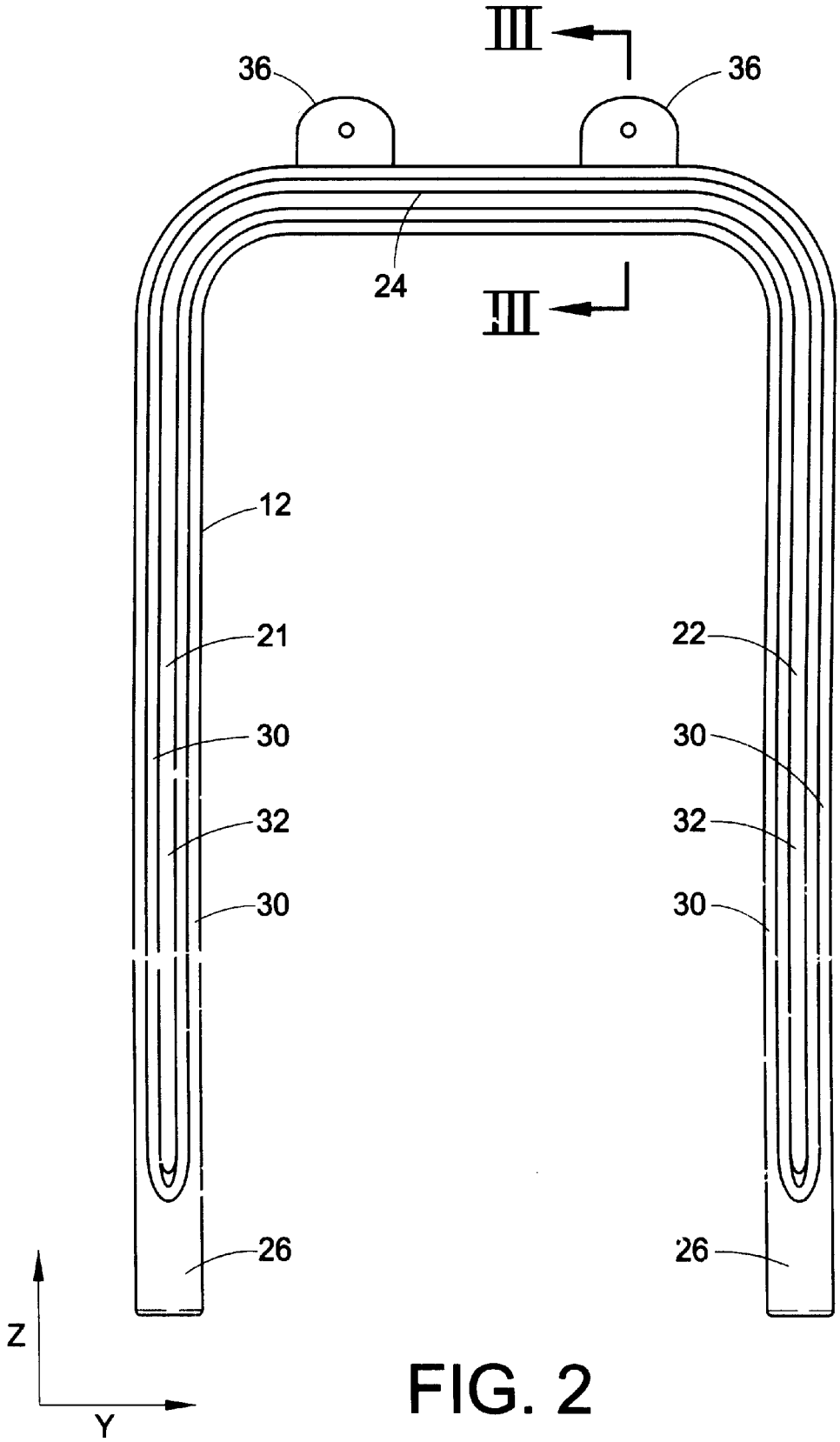
FIG. 2 is an enlarged elevational view of an upright of the barricade of FIG. 1.
Figure 3:
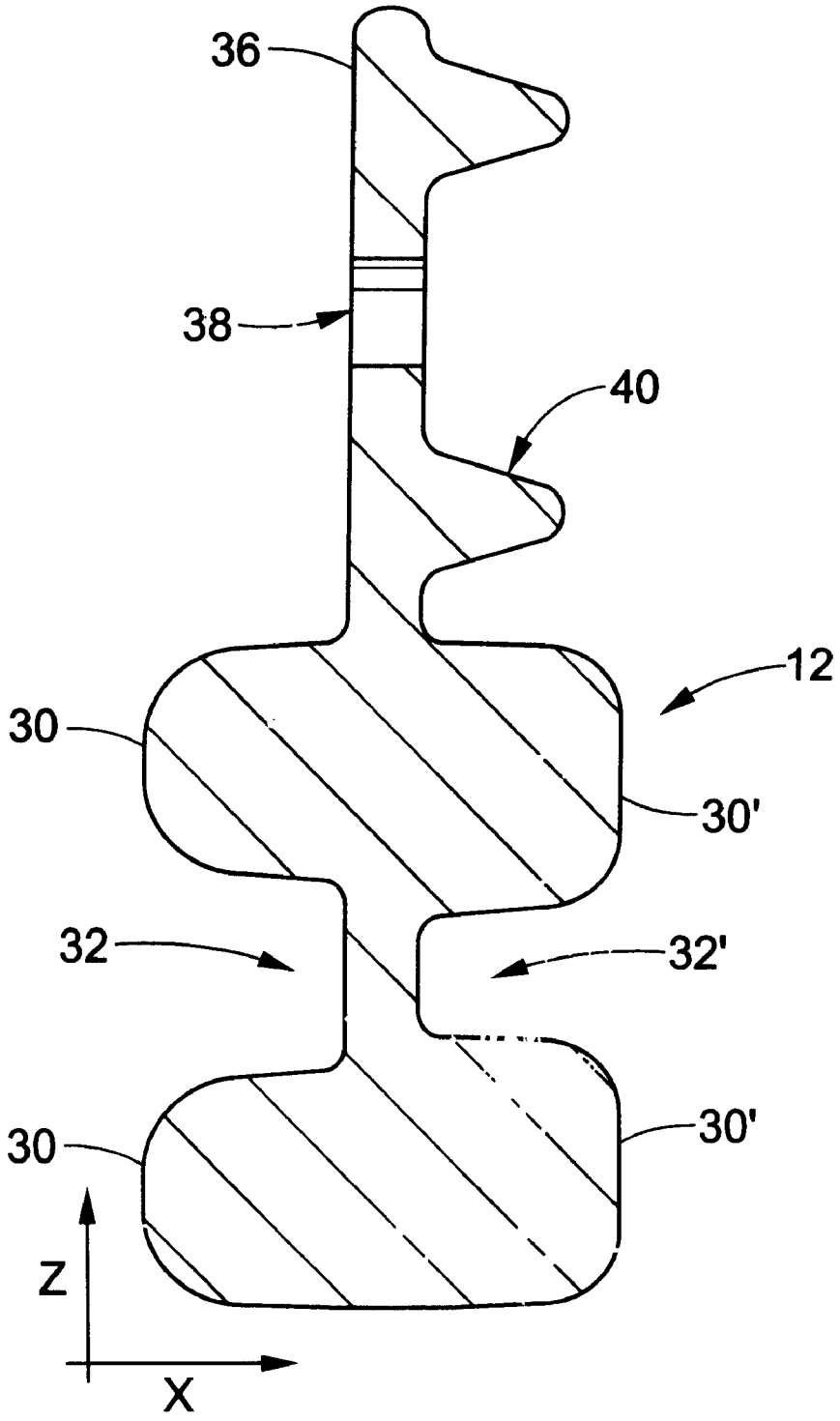
FIG. 3 is an enlarged cross sectional view taken along line III—III of FIG. 2.

With reference now to FIG. 2, upright member 12 is shown as a substantially continuous, U-shaped, piece having a pair of legs 21, 22 a central portion 24, which interconnects legs 21, 22, and opposed ends 26. The opposed ends are shaped to be closely received by corresponding sockets 28 (FIG. 5) disposed in the enlarged areas 16 of the base 10. Upright member 12 is preferably of a relatively rigid construction so that it does not bend significantly in the wind or upon slight impact. The upright member may include protrusions and indentations functioning as integrally formed structural supports. As best shown in FIG. 3, these structural supports can include a pair of spaced ribs 30 separated by a channel-shaped groove 32. The structural supports 30, 32 run substantially the length of upright member 12. As illustrated in FIG. 2, structural supports 30, 32 do not extend to the opposed ends 28 of the upright member 12. This allows the lower end of the leg members to flex slightly, upon a substantial impact, such as that of a vehicle. However, alternate embodiments could include shaped upright ends. In addition, those skilled in the art will appreciate that structural support can be functionally provided by other means such as a channel receiving a steel bar or other rigidity enhancing mechanism without departing from the spirit of the invention.

With reference now to FIG. 3, a cross section taken along line III—III of FIG. 2 is illustrated. A rigid light unit mount 36 extends away from an upper portion 24 of the upright member 12. The mount 36 is preferably formed by compression molding the front and back walls of a flange atop the upright member. As is evident, the light unit mount 36 includes an attachment point 38 for fixing a light, reflector, or other device (not shown). In the illustrated embodiment, the attachment point 38 is an eye for receiving an attachment mechanism or bolt (not shown). Further, the attachment mechanism or bolt is preferably protected or recessed within a housing 40 defined within the mount 36. When the bolt head is located within the housing 40, unauthorized removal of the bolt, and hence the light unit, is more difficult.

As noted, FIG. 3 illustrates ribs 30 and separating channel indentation 32. Additional longitudinal strength is added by applying a different compression mold to opposite sides of upright member 12. Thus, ribs 30' and channel indentation 32' do not necessarily constitute a mirror image to ribs 30 and channel 32.

In one embodiment, the upright member can be blow molded and then compression formed to assume the shape illustrated in FIGS. 2 and 3.

Figure 4:
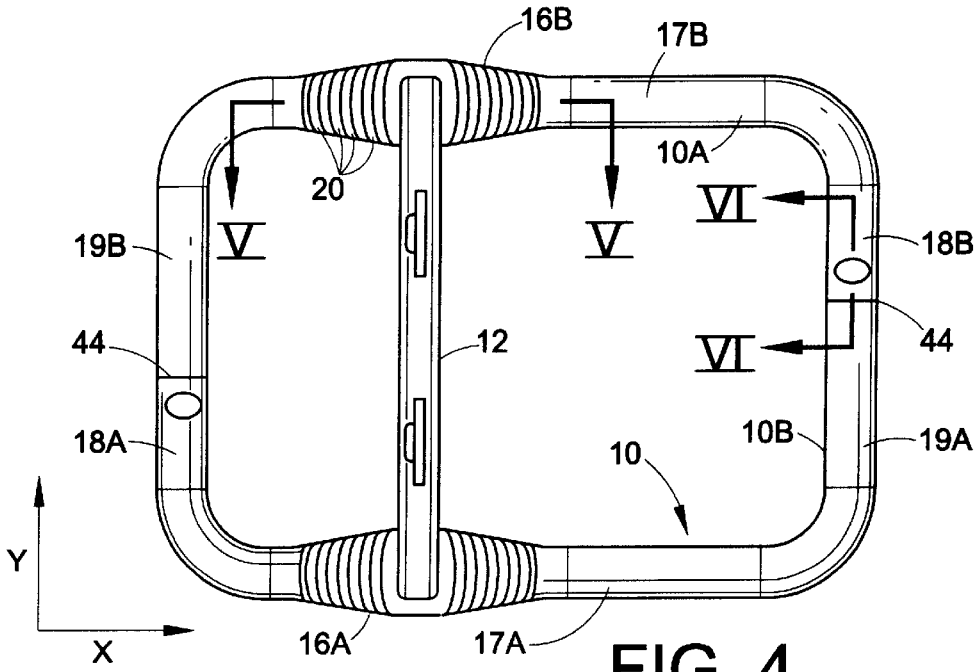
FIG. 4 is a top plan view of the barricade of FIG. 1.

With reference now to FIG. 4, the top plan view illustrates interconnecting joints 44 between base sections 10A, 10B. Additionally, it should now be apparent that enlarged portions 16 slightly increase the overall width of the base 10.

Figure 5:
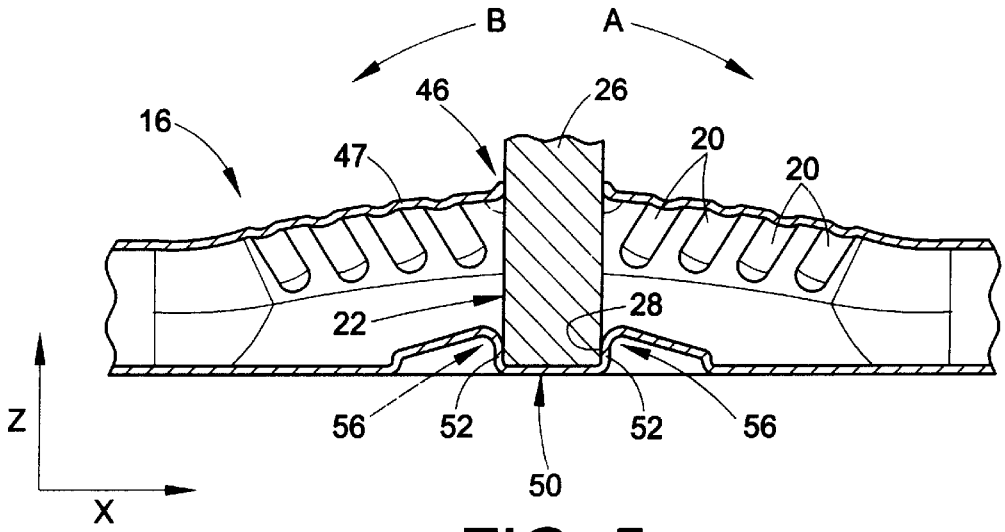
FIG. 5 is an enlarged cross sectional view taken along line V—V of FIG. 4.
Figure 5A:
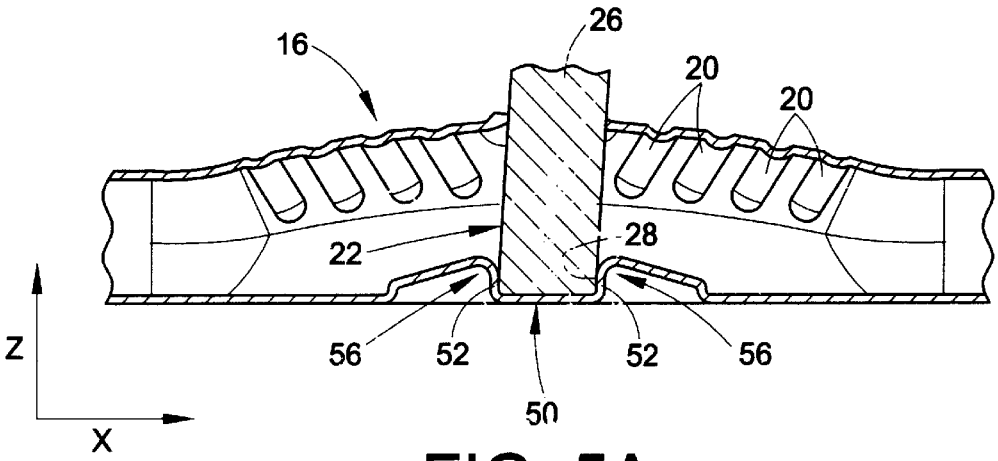
FIG. 5A is an enlarged cross sectional view taken along line V—V of FIG. 4 showing the leg member deflected.

With reference now to FIG. 5, a cross sectional view along the line V—V of FIG. 4 further illustrates the interface between the upright member 12 and the base 10. End 26 extending from the upright member 12 seats firmly within socket 28 defined by enlarged portion 16. The socket 28 includes an opening 46, formed in an upper surface 47 of the wall of the enlarged area 16. The base of the socket 28 may be defined by a lower surface 48 of the wall of the enlarged area 16. The base of the socket defines a seat 50 bordered by an annular ridge 52 integrally formed into the socket 28. Tapered corners 56 of ridge 52 permit end 26 to deflect in the direction of arrows A and B while maintaining contact with seat 50, as shown in FIG. 5A. In the process, the undulations 20 on one side become compressed, while those on the other side open out slightly to accommodate the movement of the end 26. Thus, the undulations 20 in the top surface 47 of the enlarged area 16 advantageously provide support for the upright member ends 26 while allowing slight deflections in the x direction. This construction also allows the upright member to slide out of the base 10 upon impact with a vehicle. Desirably, the ends 26 cooperating in the resilient enlarged area 16 permit the upright member 12 to deflect, rather than to fail, in response to, for example, wind gusts. Moreover, it is believed that the undulations 20 allow the upright member 12 to be pushed out of or ejected from the sockets 28 while resisting tearing of the surrounding wall of the base 10 as by a sudden impact of a vehicle. The undulations 20 create a bellows effect in the material of the base. They also facilitate the elimination of an additional support for the upright member which would otherwise be required to prevent damage around the sockets.

Figure 6:
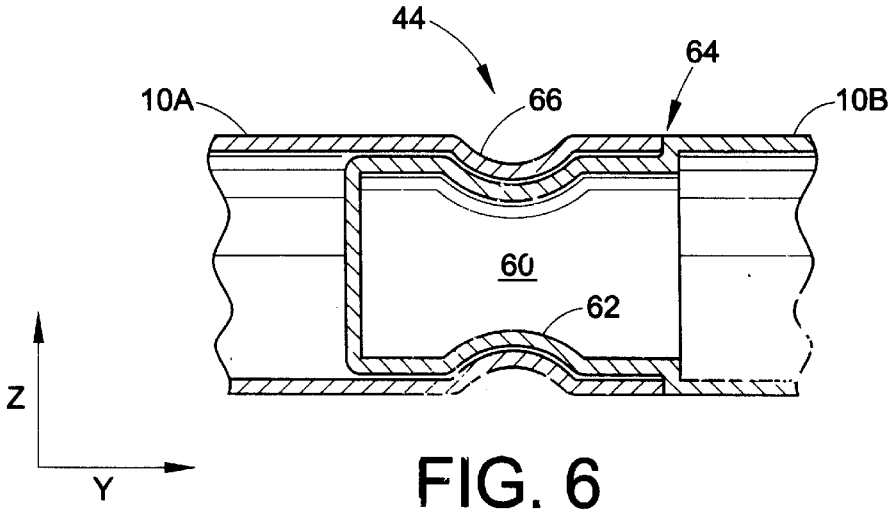
FIG. 6 is enlarged cross sectional view taken along line VI—VI of FIG. 4.

With reference now to FIG. 6, a cross sectional view along the lines VI—VI of FIG. 4 illustrates the connection between the base sections 10A. 10B which permit assembly and disassembly of the base 10. In the illustrated embodiment, base section 10B includes and end 60 with locking indentations 62. Upon urging end 60 into opening 64 of base section 10A, end 60 deflects a cooperatively shaped projection 66 which seats closely with the locking indentation 62 on the end 60. Those skilled in the art will appreciate that the illustrated interlocking mechanism is but one of many available to achieve the desirable goals of permitting the base 10 to be assembled and disassembled repeatedly.

Figure 7:
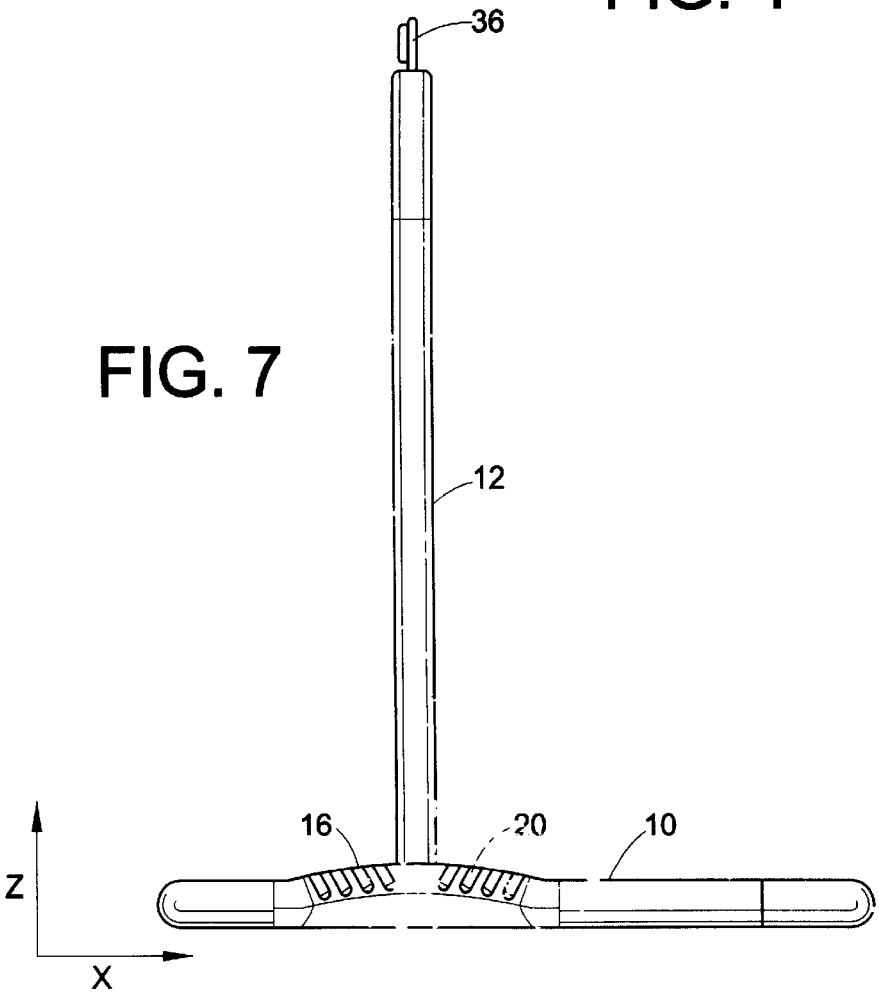
FIG. 7 is a side elevational view of the barricade of FIG. 1.

Referring now to FIG. 7, it can now be appreciated that the upright member 12 is displaced on the base 10 in the x direction. In other words, the upright member 12, hence the enlarged portions 16 are offset from the center of the base 10. Thus, the barricade has a front end 68 and a rear end 69. As is also now apparent, upright member 12 is configured to be supported only by the sockets 28 (FIG. 5) within enlarged areas 16, thus no angled supports or braces are required to support the upright member 12 perpendicularly as is typical in the art.

Figure 8:
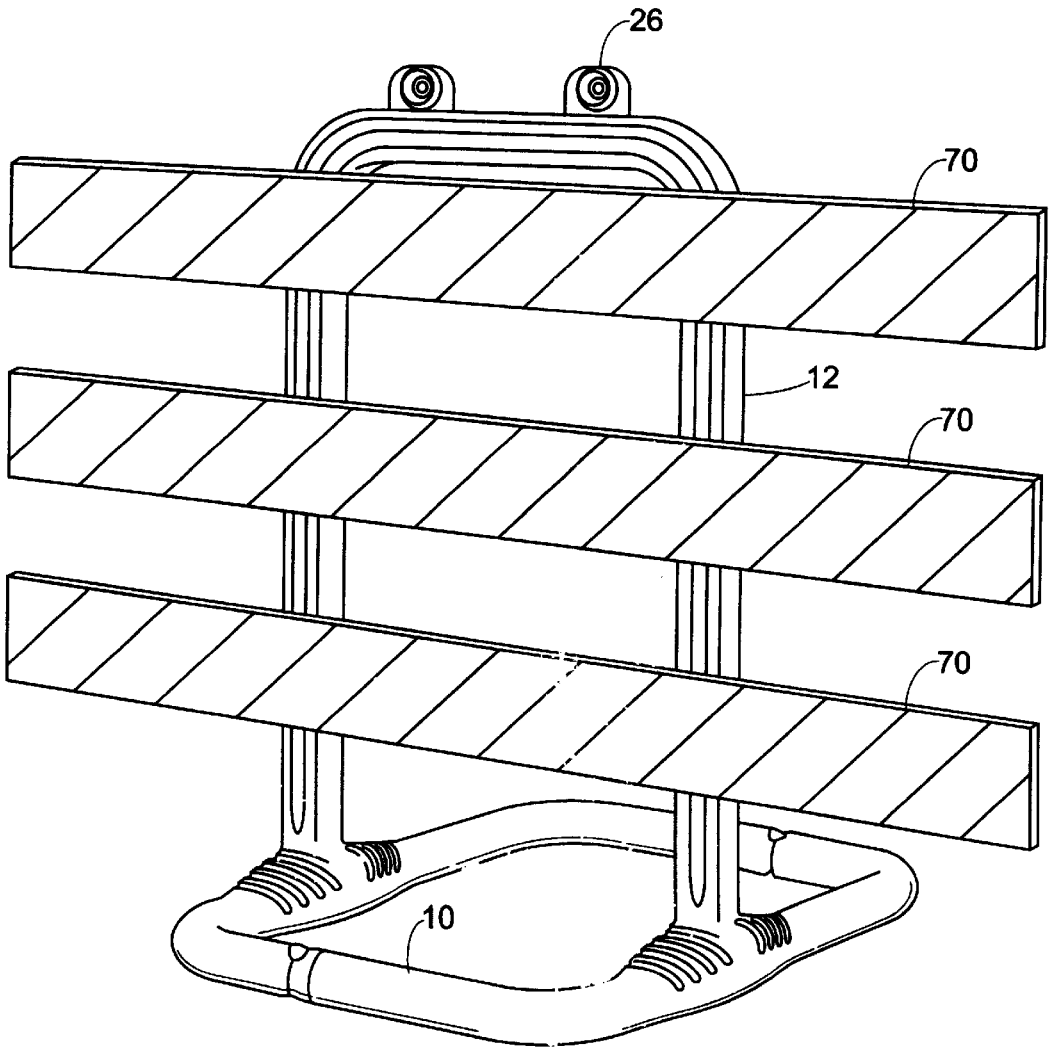
FIG. 8 is a perspective view of a molded barricade with reflective panels.

With reference now to FIG. 8, cross members or reflective panels 70 may be attached to the barricade A as desired. The panels 70 signal an instruction or warning to vehicular traffic, such as arrows indicating that the traffic should turn to the left or right, or a written warning, such as ROAD CLOSED. It is within the skill of those of ordinary skill in the art to affix panels 70 to the upright member 12 at desired locations with suitable conventional fasteners, such as screws, bolts, jacknuts, and the like. Moreover, additional resistance to inadvertent deflection or toppling can be provided by filling a blow molded void or cavity defined by the base 10 with sand or other ballast. Alternately or in addition, sand bags or the like may be placed over base 10 to increase stability.

In yet another alternative embodiment, sections 10A and 10B are not interlocked but are spaced from each other at ends 60.

The invention has been described with reference to the preferred embodiment. Modifications and alterations will occur to others upon a reading and understanding of the preceding detailed description. These modifications and alterations include continued variety in the size of the illustrated components, both in width and height, presence or absence of a light fixture, manufacturing techniques used, and attachment devices employed between various components as illustrated. It is intended that the invention be construed as including all such modifications and alterations insofar as they come within the scope of the appended claims or the equivalents thereof.

Having described the preferred embodiment, we now claim:

1. A barricade comprising:

a base including:

a first elongate support member which defines a first socket and at least one ridge adjacent said first socket, and a second elongate support member which defines a second socket and at least one ridge adjacent said second socket;

an upright member supported in a substantially upright position by the base, the upright member including:

a first leg member which is supported adjacent a first end by the first socket, and a second leg member which is supported adjacent a first end by the second socket, the ridge allowing the upright member to deflect upon impact by a vehicle; and signaling means, attached to the upright member for providing an instruction or warning to vehicular traffic.

2. The barricade of claim 1, wherein the at least one ridge includes a plurality of spaced ridges, the ridges forming a resiliently flexible portion of the respective elongate member which allows the upright member to deflect upon impact by a vehicle, and return to a generally upright position when the impact is removed.

3. The barricade of claim 1, wherein the base includes at least first and second interlocking sections, which lock together to define the base, the first elongate support member being defined by the first interlocking section and the second elongate support member being defined by the second interlocking section.

4. The barricade of claim 1, wherein the elongate support members are hollow.

5. The barricade of claim 1, wherein the upright member includes a central portion which connects the first and second leg members.

6. The barricade of claim 1, wherein the signaling means includes at least one of:

a mount which supports a lamp; and a cross member, attached to the first and second leg members, which displays a warning or instruction thereon.

7. The barricade of claim 1, wherein the sockets are configured for releasably engaging the leg members.

8. The barricade of claim 1, wherein as the upright member is deflected, the ridges in the base adjacent one side of the upright member are compressed while the ridges in the base adjacent an opposite side of the upright member are extended.

9. The barricade of claim 1, wherein the upright member includes a hollow, generally U-shaped member having a central portion, the first and second leg members defining legs of the U-shaped member which extend from the central portion in a generally parallel, spaced relation.

10. A barricade comprising:

a base including:

a first elongate support member which defines a first socket and at least one ridge adjacent said first socket, and a second elongate support member which defines a second socket and at least one ridge adjacent said second socket, the first and second sockets each including:

a seat, defined by a lower surface of the elongate member, which engages a distal surface of the leg member first end, and an opening in an upper surface of the elongate member which receives the leg member first end therethrough, the upper surface being spaced from the lower surface;

an upright member supported in a substantially upright position by the base, the upright member including:

a first leg member which is supported adjacent a first end by the first socket, and a second leg member which is supported adjacent a first end by the second socket, the ridge allowing the upright member to deflect upon impact by a vehicle; and signaling means, attached to the upright member for providing an instruction or warning to vehicular traffic.

11. A barricade comprising:

a base including:

a first elongate support member which defines a first socket, and a second elongate support member which defines a second socket, a plurality of spaced ridges formed in an enlarged section of each of the first and second elongate support members;

an upright member supported in a substantially upright position by the base, the upright member including:

a first leg member which is supported adjacent a first end by the first socket, and a second leg member which is supported adjacent a first end by the second socket, the ridges forming a resiliently flexible portion of the respective elongate member which allows the upright member to deflect upon impact by a vehicle, and return to a generally upright position when the impact is removed; and signaling means, attached to the upright member for providing an instruction or warning to vehicular traffic.

12. A barricade comprising:

a base including:

first and second interlocking sections, which lock together to define the base, a first interlocking section defining a first elongate support member and a second elongate support member being defined by the second interlocking section, the first elongate support member which defines a first socket and at least one ridge adjacent said first socket, and a second elongate support member which defines a second socket and at least one ridge adjacent said second socket;

an upright member supported in a substantially upright position by the base, the upright member including:

a first leg member which is supported adjacent a first end by the first socket, and a second leg member which is supported adjacent a first end by the second socket, the ridge allowing the upright member to deflect upon impact by a vehicle; and signaling means, attached to the upright member for providing an instruction or warning to vehicular traffic the locking means include:

a projection on the distal end of one of the leg members of one of the base interlocking sections; and a cooperatively shaped indent on the distal end of one of the leg members on the other of the base interlocking sections which receives the projection.

13. The barricade of claim 12, wherein the base interlocking sections together define four sides of a rectangle.

14. The barricade of claim 12, wherein the first and second interlocking sections each define a generally U-shaped member, the elongate support members being defined by a central portion of the U-shaped member, the U-shaped member further including first and second legs which extend from the central portion, and locking means at distal ends of the leg members.

15. A barricade comprising:

a base including:

a first elongate support member which defines a first socket and at least one ridge adjacent said first socket, and a second elongate support member which defines a second socket and at least one ridge adjacent said second socket;

an upright member supported in a substantially upright position by the base, the upright member including:

a first leg member which is supported adjacent a first end by the first socket, and a second leg member which is supported adjacent a first end by the second socket, the ridge allowing the upright member to deflect upon impact by a vehicle, the leg members and central portion defining ribs which extend longitudinally along the leg members and central portion to provide structural support for the upright member; and signaling means, attached to the upright member, for providing an instruction or warning to vehicular traffic.

16. The barricade of claim 15, wherein the ribs are spaced from the ends of the leg members.

17. A barricade comprising:

a base which supports an upright member in a generally vertical orientation, the upright member having first and second distal ends, the base including two removably interlocking sections, each interlocking section including:

a socket for closely receiving one of the distal ends of the upright member; and a resilient, deformable area in the interlocking section adjacent the socket, the deformable area deforming when the barricade is subjected to an impact, permitting the upright member to deflect somewhat and then return to a generally vertical orientation when the impact is removed.

18. The barricade of claim 17, wherein the upright member is generally U-shaped.

19. The barricade of claim 18, further including:

at least one cross member which interconnects generally vertical leg members of upright member, the cross member displacing a warning or instruction to road users.

20. The barricade of claim 16, further including:

a warning light mounted to a top portion of the U-shaped upright member.

* * * * *